US005140839A

United States Patent [19]

Bruns

[11] Patent Number: 5,140,839

[45] Date of Patent: Aug. 25, 1992

[54] CROSS BAR TRANSFER PRESS

[75] Inventor: Eilert F. Bruns, Naperville, Ill.

[73] Assignee: Hitachi Zosen Clearing, Inc., Chicago, Ill.

[21] Appl. No.: 722,148

[22] Filed: Jun. 27, 1991

[51] Int. Cl.[5] ..... B21D 43/05

[52] U.S. Cl. ..... 72/405; 198/621; 414/752

[58] Field of Search ..... 72/405, 421; 414/750–752; 198/621

[56] References Cited

U.S. PATENT DOCUMENTS

| | | | |
|---|---|---|---|
| 3,937,056 | 2/1976 | Henzler | 72/405 |
| 4,299,533 | 11/1981 | Ohnaka | 414/752 |
| 4,361,413 | 11/1982 | Toda | 72/405 |
| 4,372,538 | 2/1983 | Balfanz | 414/751 |
| 4,411,587 | 10/1983 | Niki | 72/405 |
| 4,487,409 | 12/1984 | Orii | 72/405 |
| 4,609,324 | 9/1986 | Sphar | 414/750 |
| 4,873,860 | 10/1989 | Werner | 72/405 |
| 4,921,395 | 5/1990 | Sahlin | 414/744.3 |
| 4,970,888 | 11/1990 | Shiraishi | 72/405 |
| 5,001,921 | 3/1991 | Schneider | 72/405 |
| 5,002,448 | 3/1991 | Kamijima | 414/751 |
| 5,003,808 | 4/1991 | Maher | 72/405 |

FOREIGN PATENT DOCUMENTS 1395058 5/1975 United Kingdom .

*Primary Examiner*—Daniel C. Crane
*Attorney, Agent, or Firm*—Emrich & Dithmar

[57] ABSTRACT

A mechanical transfer press employs a plurality of paired self-supporting, stroke doubling transfer/feed mechanisms, with each pair of transfer/feed mechanisms coupled to a cross bar, for sequentially transferring piece parts to a series of stamping stages in the press. Vacuum cups attached to the cross bar engage one or more piece parts for transferring the piece parts to the next stage. Each transfer/feed mechanism includes a lift/lower drive as well as a feed/return drive for positioning piece parts intermediate upper and lower dies of the press and for removing the cross bar and vacuum cups from the stamping stage prior to the stamping operation. Each pair of transfer/feed mechanisms is positioned above its associated stamping stage to facilitate access to and increase clearance from the dies. Each pair of transfer/feed mechanisms with its associated dies forms a press module which can be easily removed and replaced as well as individually adjusted in its feed/return and lift/lower distances and motion profile independent of other such modules. A programmable numeric controller is used to control press as well as transfer/feed mechanism operation.

25 Claims, 7 Drawing Sheets

Fig. 5.
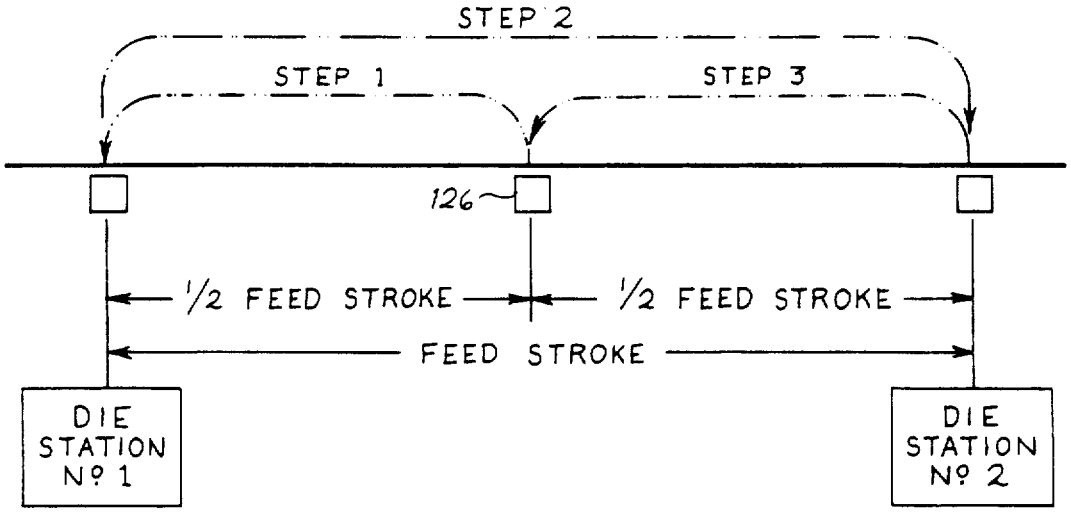
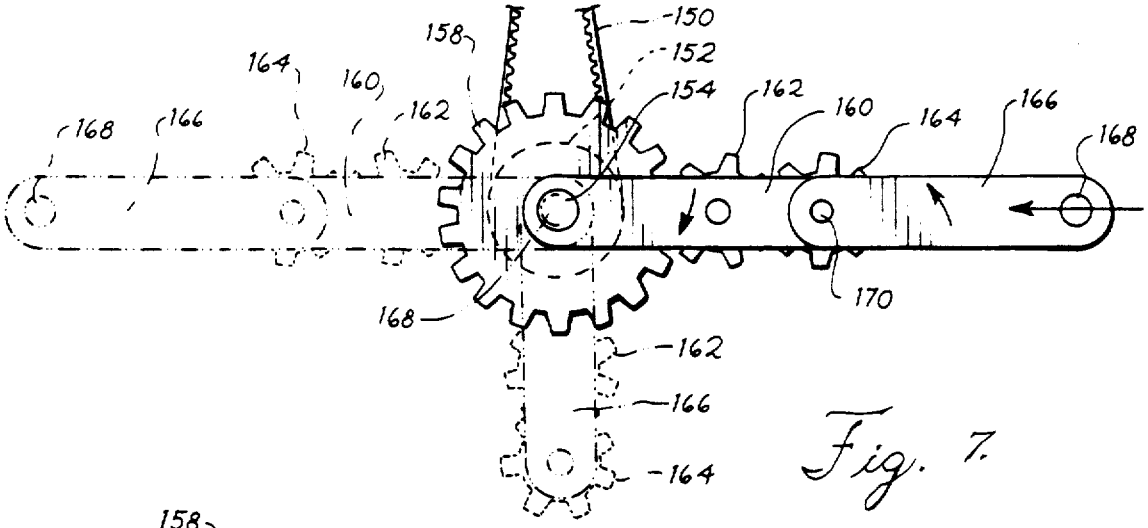
Fig. 7.
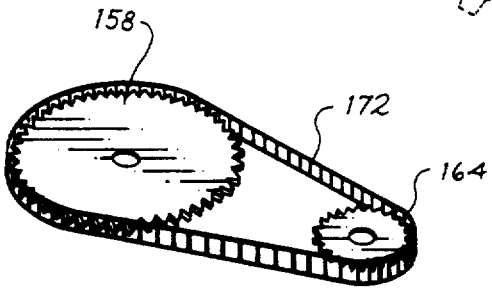
Fig. 8.

CROSS BAR TRANSFER PRESS

FIELD OF THE INVENTION

This invention relates generally to mechanical transfer presses and is particularly directed to a cross bar transfer press and a piece part transfer/feed mechanism for use therein.

BACKGROUND OF THE INVENTION

Sheet metal piece parts such as used in automobiles, appliances, aircraft, farm implements, construction equipment, etc., are typically formed by a series of stamping operations in a multi-stage mechanical transfer press which manipulate the work piece to a desired shape and size. Each stamping operation makes use of a pair of dies which engage the sheet metal piece part and form it as desired.

In early multi-stage presses, each piece part was transferred manually from one stage to the next. This proved to be slow and dangerous and gave way to automated transfer arrangements where each piece part is sequentially moved into position in the various stamping stages. The piece part is engaged by a clamp or vacuum cups attached to mechanical linkage for moving the piece part between stamping stages. One common approach makes use of a tri-axis transfer drive mechanism employing a large and complicated arrangement of transfer lift/lower, feed/return, and clamp/unclamp cams. These cams, in turn, drive the combination of transfer feed, clamp and lift carriages which displace a pair of parallel, spaced feed bars in a timed manner. This approach suffers from the complex displacement sequence through which the lift bars are moved and the associated expensive and complicated drive system.

In an effort to improve on the tri-axis transfer drive mechanism, a cross bar transfer approach was developed. In this approach, one or more cross bars span the pair of parallel, spaced lift bars and have associated therewith a plurality of vacuum cup arrays. Each vacuum cup array is adapted to engage and transport a given piece part, allowing the cross bar transfer mechanism to transport a plurality of piece parts from one stamping station to the next.

Referring to FIG. there is shown an upper perspective view of a cross bar transfer press 20 of the prior art. The cross bar transfer press 20 includes a cam box 22 enclosing a transfer lift cam 24, a transfer feed cam 26, and various gears 28 for engaging and displacing first and second lift bars 30 and 32 and cross bars 42 and 44 via first and second control arms 34 and 36. No. 38 identifies a feed bar motion diagram illustrating the sequential displacement of the lift bars 30, 32 and cross bars attached thereto during each stamping cycle. A plurality of spaced cross bars extend between and are coupled to each of the first and second lift bars 30, 32, with first and second cross bars respectively identified as elements 42 and 44. Displacement of cross bars 42, 44 begins at the upper left of the feed bar motion diagram 38 and proceeds rightward to a position where the piece parts are deposited on a given die. Following deposit of the piece parts, the cross bars are displaced leftward to an intermediate position of the feed bar motion diagram 38. After the piece parts are stamped, the cross bars 42, 44 are displaced leftward by means of the control arms 34 and 36 to the starting point of the motion diagram.

Each of the first and second cross bars 42, 44 is provided with a plurality of vacuum cups 56 for engaging and supporting first and second piece parts 46 and 48. The piece parts are displaced in the direction of the arrow in the figure in a sequential manner to each of the stamping stations. Moving bolsters 52 and 54 support one or more lower dies 58 upon which each piece part is sequentially positioned. A plurality of upper dies (not shown in the figure for simplicity) positioned above each of the respective lower dies 58 is then displaced downward by a suitable press drive mechanism for stamping each piece part. The press is also used to drive the workpiece transfer mechanism shown in the figure by suitable gearing and power take-off units such as the transfer power take-off shaft 40. The press is positioned above the transfer mechanism shown in the figure and is supported and maintained in position by means of a plurality of spaced press uprights 50*a*, 50*b* and 50*c*. Before each piece part is formed by a series of stampings, a plurality of vacuum cups 60 engage each piece part and load it to the cross bar transfer press 20. Delivery is from a sheet washing unit 62. The piece parts are earlier separated by means of vacuum cups 64 for sheet destacking and are then delivered via a magnet belt 66 to the washing unit 62. The piece parts are initially arranged in stacks 70 on a pallet 72.

The cross bar transfer press 20 shown in FIG. 1 also suffers from various limitations. For example, the location of the lift bars 30, 32 as well as the cross bars 42, 44 attached thereto make it difficult to gain access to the lower dies 58 for repair or replacement. Furthermore, connection of all of the cross bars to and the driving of the cross bars by control arms 34 and 36 precludes individual adjustment of cross bar position at each stamping station. Also, each die pair must be precisely positioned relative to the other die pairs in the multi-stage cross bar transfer press 20 in order to ensure uniform stamping of all piece parts at every stamping stage. Finally, because piece part pass line height varies from press stage to press stage, it is desirable to adjust upper die lift travel depending upon piece part thickness. Minimizing die lift travel increases press speed. However, individual adjustment of displacement of the cross bar and vacuum cup transfer mechanism of transfer press 20 shown in FIG. is precluded because each transfer mechanism is mounted to the first and second lift bars 30, 32.

OBJECTS AND SUMMARY OF THE INVENTION

The present invention overcomes the aforementioned limitations of the prior art by providing a mechanical transfer press employing a plurality of paired self-supporting, independently acting, stroke doubling transfer/feed mechanisms, with each pair of transfer/feed mechanisms coupled to a cross bar for sequentially transferring piece parts from one stamping station to another stamping station. Each pair of transfer/feed mechanisms in combination with their associated stamping station forms a transfer press module which can be operated and controlled independent of other modules in the transfer press. Each pair of transfer/feed mechanisms and associated cross bar may be displaced from between adjacent stamping stations to facilitate repair and/or replacement of stamping station dies.

Accordingly, it is an object of the present invention to provide an improved cross bar transfer press which is less expensive and more flexible in terms of compensation for differences between individual stamping stations than prior art transfer presses and can be retrofit into existing systems.

Another object of the present invention is to provide a press module including dies and piece part transfer/-feed mechanisms for use in a mechanical transfer press which is easily removed and replaced for minimizing press down time.

Yet another object of the present invention is to provide a modular mechanical transfer press which allows for adjustment of transfer mechanism feed/return and lift/lower distances as well as changes in die motion profiles and lower/lift heights for each individual stamping station.

A further object of the present invention is to provide a piece part transfer/feed mechanism for a mechanical press which is of simple design, lightweight, strong, compact and affords improved access to and increased clearance with the press dies.

A still further object of the present invention is to simplify and reduce the cost of a mechanical transfer press and particularly its transfer/feed arrangement.

It is another object of the present invention to increase the speed and reliability of the transfer of piece parts between adjacent stamping stages in a mechanical transfer press.

A further object of the present invention is to provide a transfer/feed mechanism for use in a mechanical transfer press which is particularly adapted for high speed operation under the control of a programmable controller.

This invention contemplates a transfer press wherein a piece part sequentially undergoes a series of stamping operations for forming the piece part into a desired configuration and size, the transfer press comprising: a plurality of die stations arranged in a linear, spaced manner for stamping a piece part in a predetermined sequence for forming the piece part into a desired configuration and size, each of the die stations including a fixed lower die and a vertically moveable upper die adapted for engaging a piece part disposed on the lower die in a stamping manner; a plurality of cross bars each disposed intermediate a pair of adjacent die stations, wherein each of the cross bars includes grippers or vacuum cups for securely engaging a piece part; a plurality of paired transport/feed mechanisms, wherein each pair of transport/feed mechanisms is disposed intermediate adjacent die stations and is coupled to a respective one of the cross bars for transferring one or more piece parts between adjacent die stations, each of the transport/feed mechanisms including a pivotally displaced link coupled to a cross bar for moving the cross bar in a reciprocating manner between adjacent die stations; and a controller coupled to each of the transport/feed mechanisms for moving the cross bars in timed sequence with operation of the transfer press.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

FIG. 5 is a motion diagram illustrating the stepwise displacement of a cross bar in the improved cross bar transfer press of the present invention;

FIG. 7 is a plan view of a portion of the transfer/feed mechanism shown in FIG. 6 illustrating the transfer/-feed mechanism in several configurations assumed during transfer of a piece part between adjacent stamping stations in the cross bar transfer press;

FIG. 8 is a perspective view of another drive arrangement for use in coupling the drive and driven gears on the inner feed/return link of the transfer/feed mechanism shown in FIG. 6;

DETAILED DESCRIPTION OF THE INVENTION

Figure 1:
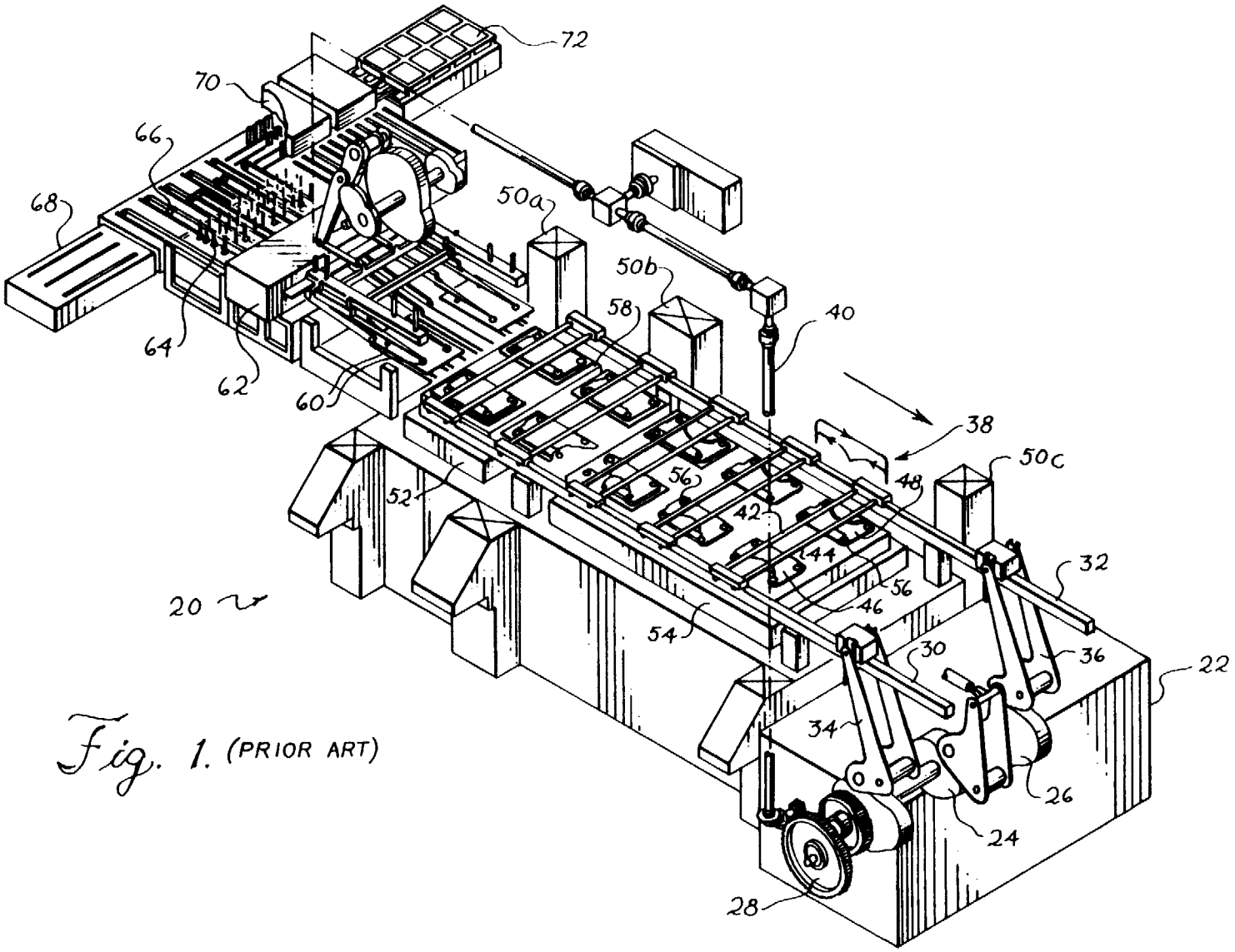
Fig. 1. (PRIOR ART)
FIG. 1 is a partial perspective view of a prior art cross bar transfer press.
Figure 2:
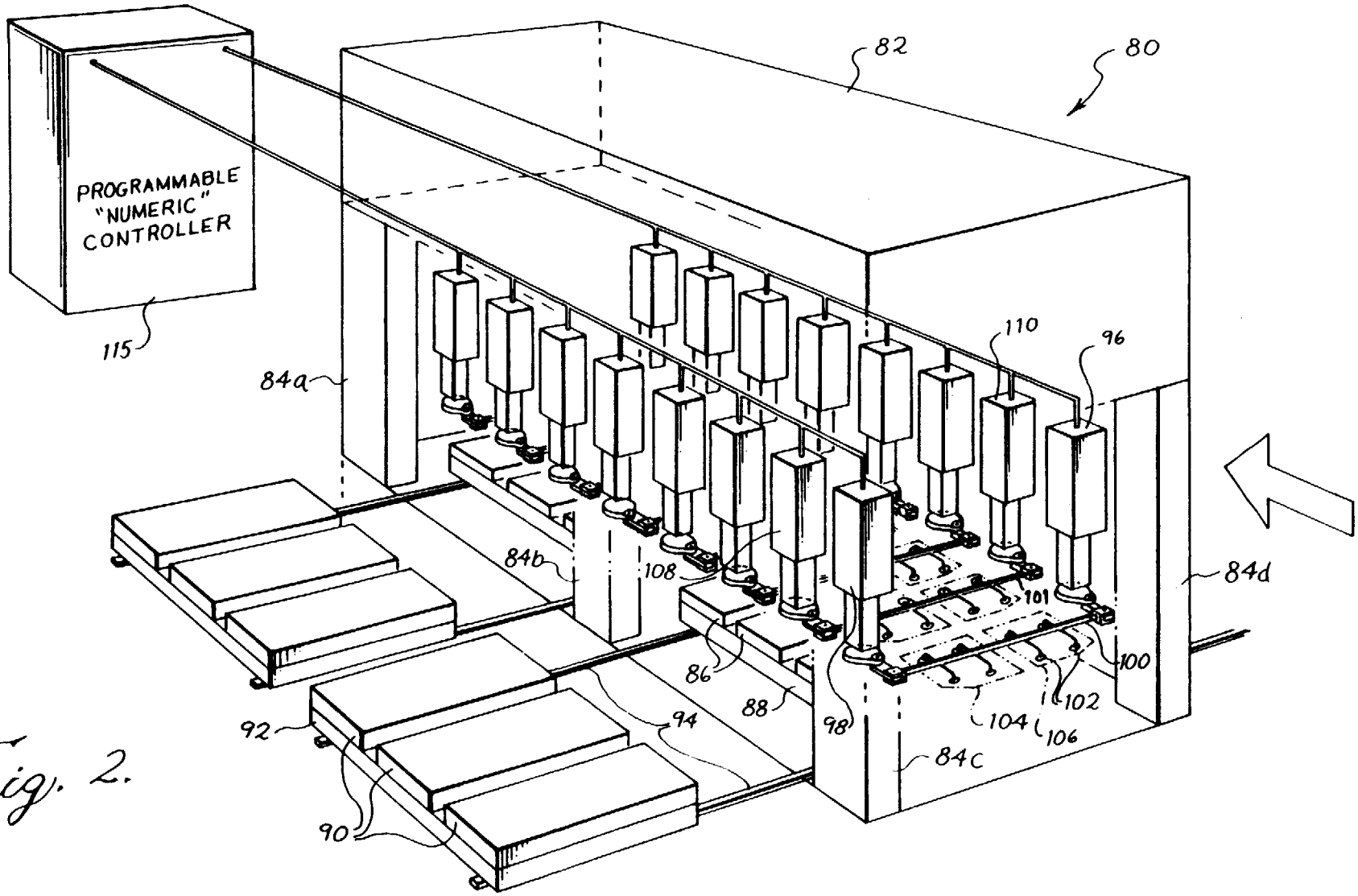
FIG. 2 is a partial perspective view of an improved cross bar transfer press in accordance with the principles of the present invention.

Referring to FIG. 2, there is shown a partial perspective view of an improved cross bar transfer press 80 in accordance with the present invention. The cross bar transfer press 80 includes an upper press housing 82 within which is positioned suitable gears, levers and other press drive mechanisms for displacing a plurality of upper dies (not shown in the figure for simplicity) in a downward direction toward respective ones of a plurality of lower dies (also not shown in the figure). Each of the lower dies is positioned on a respective one of a plurality of bolsters 86 arranged in a spaced manner along the length of and beneath the press housing 82. Each of the bolsters 86 is positioned upon and supported by a first moveable bolster carrier 88. A second plurality of bolsters 90 is positioned upon and supported by a second moveable bolster carrier 92. Each of the first and second bolster carriers 88, 92 is positioned upon and moveable along a pair of spaced carrier rails, or tracks, 94. This arrangement allows for a first set of dies disposed on the first bolsters 86 to be used in the cross bar transfer press 80 interchangeably with a second set of lower dies positioned on the second bolsters 90. A change in the dies of the cross bar transfer press 80 is required when changing from one stamping operation to another. A transport mechanism (not shown for simplicity) is included within the first and second bolster carriers 88 and 92 for moving one of the two sets of lower dies in position in the cross bar transfer press 80. The transport mechanism may be conventional in design and operation and typically includes an electric motor and drive arrangement for displacing the bolster carriers along the carrier rails 94.

Press housing 82 is positioned upon and supported by a plurality of spaced press uprights 84*a*, 84*b*, 84*c* and 84*d*. Disposed below the press housing 82 and above the lower dies and bolsters 86 are a plurality of transfer/-feed mechanisms arranged in a pair of spaced, linear arrays. With piece parts entering the cross bar transfer press 80 in the lower right and moving in the direction of the arrow in the figure toward the upper left, a pair of piece parts 104 and 106 (shown in the figure in dotted-line form) ar initially transported by a first pair of transfer/feed mechanisms 96 and 98. Transfer/feed mechanisms 96, 98 displace the piece parts 104 and 106 to the first stamping station in the cross bar transfer press 80. Following this first stamping operation, the two piece parts are then engaged and transported to a second stamping stage by a second pair of transfer/feed mechanisms 108 and 110. The first pair of transfer/feed mechanisms 96, 98 are coupled by a first cross bar 100, while the second pair of transfer/feed mechanisms 108, 110 are coupled by a second cross bar 101. Each of the cross bars 100, 101, and all other cross bars in the cross bar transfer press 80, includes a plurality of vacuum cups 102 for sheet handling. Each of the vacuum cups is coupled to a vacuum source (also not shown in the figure for simplicity) for engaging and transporting a piece part to the next stamping station. The operation and configuration of the vacuum cups 102 as well as the vacuum source is well known to those skilled in the art and is therefore not described in greater detail herein. While the present invention is disclosed as employing vacuum cups 102 for engaging and transporting piece parts, other forms of piece part engaging means such as mechanical grippers may be used equally as well. In addition, while a pair of work pieces are shown engaged by each cross bar, virtually any number of workpieces may be simultaneously transported by a single cross bar in the present invention.

Each of the transfer/feed mechanisms within the cross bar transfer press 80 is coupled to a programmable controller 115. The programmable controller 115 controls the operation of each of the transfer/feed mechanisms in a timed manner so as to provide for the sequential displacement of the piece parts through each stamping station of the cross bar transfer press 80. Thus, the programmable controller 115 causes each of the transfer/feed mechanisms to simultaneously lift/lower or displace forward/aft each cross bar in engaging and transporting the workpieces. The programmable controller 115 may also be used to control the operation of the cross bar transfer press 80 in the timed upward and downward displacement of the upper dies of the transfer press. The programmability of the controller 115 allows for changes in the timed operation of each of the transfer/feed mechanisms for a change in the stamping operation carried out by the cross bar transfer press 80. Similarly, the programmable controller 115 allows for individual control of the operation of each pair of associated transfer/feed mechanisms at each respective stamping station. Thus, operating parameters such as transfer/lift mechanism lift travel and dwell time may be established in accordance with a particular stamping operation. An example of a programmable controller 115 for use in the cross bar transfer press 80 is the Dual Axis Motion Profile Controller (MPC) designed to provide accurate servo control for dual axis coordinated motions of mechanical press transfer/feed mechanisms which is available from Unico, Inc. of Franksville, Wis. The MPC is a 68000 microprocessor based system incorporating a permanently programed EPROM and incorporating closed-loop digital control utilizing a software tunable system. The MPC system further includes a video display with an interactive menu screen through which an operator can set up system parameters for particular stamping operations, edit motion profiles, monitor system performance, and receive and process operating information.

Figure 4:
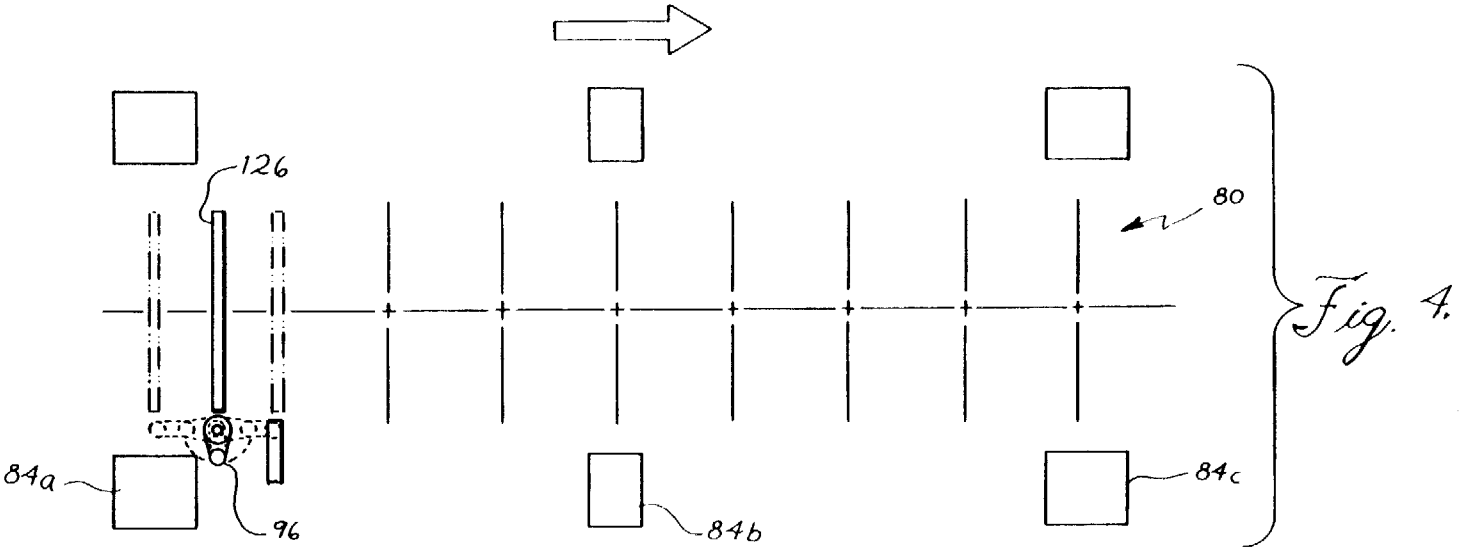
FIG. 4 is a partial plan view of the improved cross bar transfer press of FIG. 3 showing the cross bar of the transfer mechanism in various positions.
Figure 3:
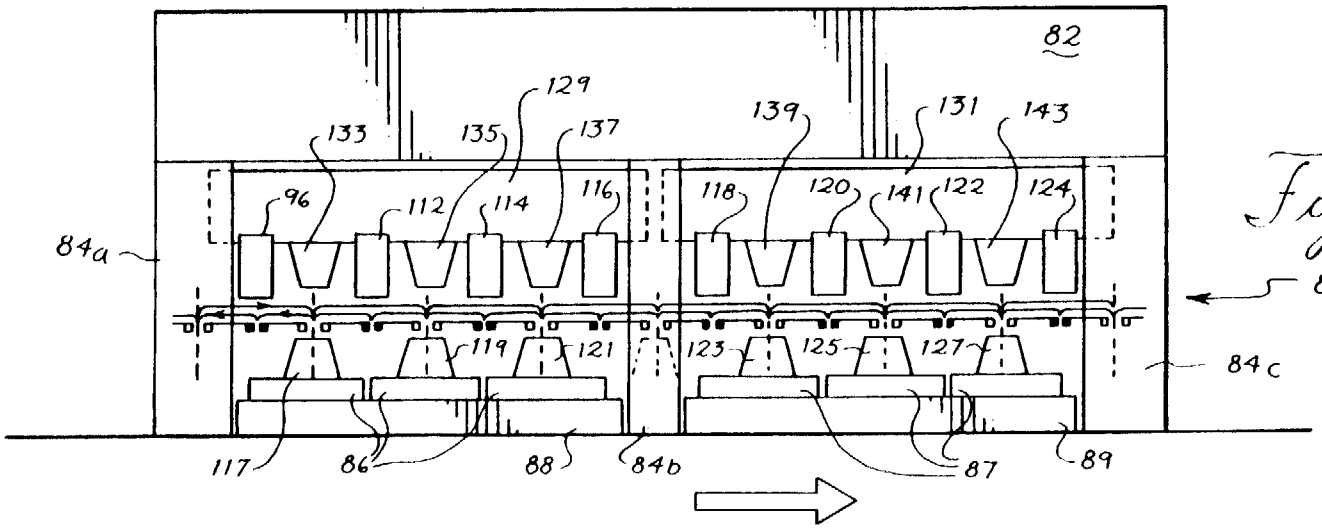
FIG. 3 is a simplified side view of the improved cross bar transfer press of FIG. 1 illustrating the location of the various stamping stations therein.

Referring to FIG. 3, there is shown a simplified side view of the improved cross bar transfer press 80. A partial plan view of the improved cross bar transfer press 80 is shown in FIG. 4. In FIGS. 3 and 4, the piece parts are moved in the direction of the arrows shown therein in traversing the various stamping stations. As shown in FIG. 3, there are six stamping stations, with the first three stations positioned upon bolsters 86 and bolster carrier 88 and the last three stamping stations positioned upon bolsters 87 and bolster carrier 89. A plurality of lower dies 117, 119, 121, 123, 125 and 127 are securely mounted to bolsters 86 and 87 and are adapted for receiving a piece part on an upper surface thereof. Disposed in a spaced manner above and between adjacent lower dies are a plurality of the transfer/feed mechanisms 96, 112, 114, 116, 118, 120, 122 and 124.

The cross bar transfer press 80 further includes first and second press slides , or guides, 129 and 131 respectively disposed above the first and second bolster carriers 88 and 89. Attached to and suspended from the first press slide 129 are a first plurality of upper dies 133, 135 and 137. Similarly, coupled to and suspended from the second press slide 131 are a second plurality of upper dies 139, 141 and 143. Each of the aforementioned upper dies is adapted for sliding displacement within its associated press slide in a generally vertical direction. Thus, when a piece part is positioned upon a lower die, the upper die associated therewith is displaced downward toward the lower die so as to engage the piece part in a stamping action. The upper die is then withdrawn from the piece part in an upward, generally vertical direction by its associated press slide. The reciprocating displacement of each of the upper dies is repeated each stamping cycle as the piece parts are sequentially moved toward the right as shown in FIGS. 3 and 4 in stamping the piece parts into the desired size and shape.

The plan view of FIG. 4 shows the position of a cross bar 126 relative to its associated transport/feed mechanisms during a stamping cycle, where only one of the transfer/feed mechanisms 96 is shown in the figure for simplicity. Cross bar 126 is displaced in a reciprocating manner between the two positions shown in dotted-line form. The intermediate position of the cross bar 126 where it is shown in solid lines represents the location after a piece part is deposited by the cross bar 126 on a lower die (not shown in the figure).

FIG. 3 includes a displacement diagram for each cross bar at each stamping station. The arrowheads indicate the direction of travel of the cross bar 126 during a stamping cycle. An enlarged view of the cross bar displacement diagram is shown in FIG. 5. Cross bar 126 is initially positioned immediately below its associated transfer/feed mechanism and is first displaced in step 1 to the left for engaging a piece part positioned at a first die station. Next, the cross bar 126 is displaced in step 2 to the right for transporting the piece part to the second die station. In step 3, cross bar 126 is again displaced to the left to a position intermediate the first and second die stations during the stamping operation of piece parts at each of these stations. Following the stamping of the piece parts at the die stations, the stepwise displacement sequence of each of the cross bars is re-initiated and another stamping cycle is carried out. From FIG. 5, it can be seen that in steps 1 and 3 cross bar 126 is displaced ½ a feed stroke. The transfer/feed mechanism used in the present invention is adapted for feed strokes on the order of 100 inches and more. From FIG. 4, it can be seen that pivoting displacement of the transfer/feed mechanism 96 effects displacement of cross bar 126 and piece parts attached thereto from a first to a second stamping station as shown in FIG. 5.

Figure 6:
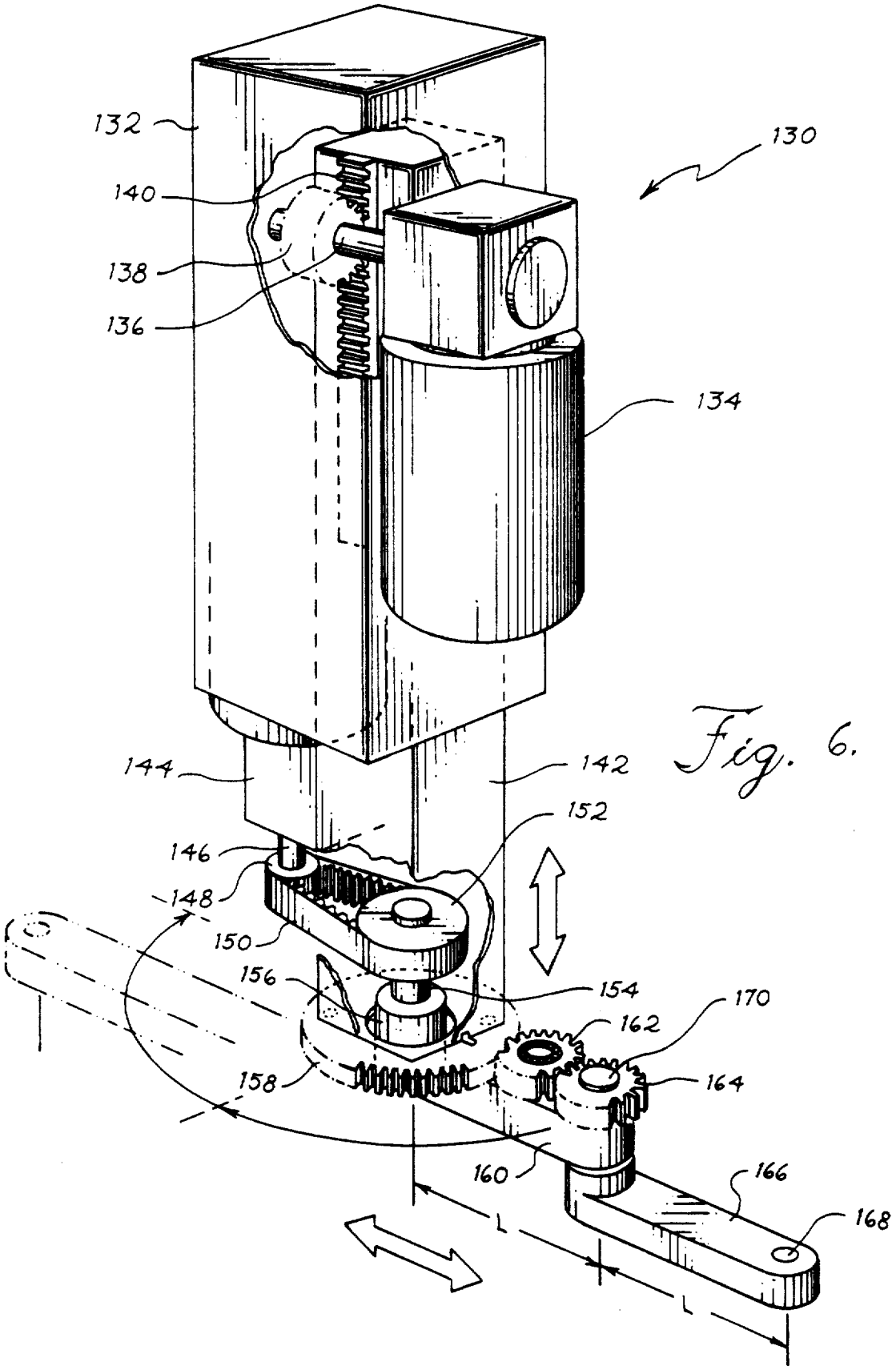
FIG. 6 is a partially cutaway perspective view of a transfer/feed mechanism for use in the inventive cross bar transfer press.

Referring to FIG. 6, there is shown a partially cutaway perspective view of a transfer/feed mechanism 130 used in a preferred embodiment of the present invention. The transfer/feed mechanism 130 includes a housing 132 to which is fixedly attached a lift/lower motor 134. Extending from and rotationally displaced by the lift/lower motor 134 is a shaft 136. Attached to shaft 136 is a pinion 138 which engages a rack 140 disposed on a lift/lower arm 142 attached to and extending downward from housing 132 in a telescoping manner. Rotational displacement of pinion 138 by the lift/lower motor 134 allows for the raising or lowering of the lift/lower arm 142 as shown in the figure. Attached to the lift/lower arm 142 is a motor and reducer 144 from which extends a shaft 146 in a downward direction. Disposed on the end of shaft 146 is a drive tooth pulley 148 coupled by means of a drive tooth belt 150 to a driven tooth pulley 152. Driven tooth pulley 152 is disposed within the lift/lower arm 142. Driven tooth pulley 152 is, in turn, coupled by means of a shaft 154 to an inner link hub 156. Inner link hub 156 is disposed on a first end of an inner feed/return link 160. Disposed about the inner link hub 156 and fixedly attached to the lift/lower arm 142 is a fixed, or stationary, gear 158. Disposed on a second end of the inner feed/return link 160 is an outer gear 164. Rotationally mounted to an intermediate position of inner feed/return link 160 is an idler gear 162 which engages fixed gear 158 and outer gear 164. Outer gear 164 is connected by means of a coupling pin 170 to a first end of an outer feed/return link 166. Coupling pin 170 is inserted through a aperture in the second end of the inner feed/return link 160 for pivoting coupling thereto. The outer feed/return link 166 is thus pivotally coupled to the second, or distal, end of the inner feed/return link 160. Disposed on the distal end of the outer feed/return link 166 is a pivot connection 168 for coupling the transfer/feed mechanism 130 to a cross bar as shown in FIG. 2. The inner and outer feed/return links 160, 166 are essentially the same length, L.

Transfer/feed mechanism 130 operates in the following manner in moving piece parts in the transfer press. Raising and lowering of the cross bar is effected by the lift/lower motor 134 in combination with the rack and pinion 140, 138 combination for raising and lowering the lift/lower link 142. As drive tooth pulley 148 and driven tooth pulley 152 are rotationally displaced by the motor and reducer 144, the inner feed/return link 160 is similarly pivotally displaced about the axis of shaft 154. With fixed gear 158 mounted in a stationary manner to the lift/lower link 142, rotational displacement of the inner feed/return link 160 causes a corresponding rotation of idler gear 162 and the outer gear 164. Rotation of outer gear 164 causes a corresponding rotational displacement of the outer feed/return link 166. It is in this manner that the pivot connection 168 disposed on the distal end of the outer feed/return link 166 is linearly displaced from a first fully extended position shown in solid line form in FIG. 6 to a second, opposed position shown in dotted-line form in the figure. The transfer/feed mechanism 130 is commonly referred to as a motion doubling device, where the two positions of the mechanism illustrated in FIG. 6 correspond to positioning of a cross bar coupled to the mechanism at two adjacent stamping stations. It should be noted that the pivot connection 168 disposed on the distal end of the outer feed/return link 166 travels in a straight line passing directly below shaft 154 as the transfer/feed mechanism 160 is moved between the two configurations shown in FIG. 6.

Referring to FIG. 7, there is shown a simplified plan view partially in phantom of three configurations assumed by the transfer/feed mechanism's inner feed/return link 160 and outer feed/return link 166 during transfer of a piece part. A piece part is transferred in the direction of the arrow shown in the figure, or from right to left. The fully extended position to the right represents the position of the transfer/feed mechanism when positioned at die station no. 2, while the fully extended configuration shown in dotted-line form to the left represents the position of the transfer/feed mechanism at die station no. 1 as shown in FIG. 5. An intermediate position of the inner and outer feed/return links is shown in dotted-line form where the two links are folded upon one another. As shown in FIG. 7, initial displacement to the left is caused by clockwise rotation of the inner feed/return link 160 about the axis of shaft 154, and the counter-clockwise rotation of the outer feed/return link 166 about the axis of coupling pin 170. Continued rotation of the inner and outer feed/return links 160, 166 causes the outer feed/return link to be positioned immediately above the inner feed/return link as shown in dotted-line form in a lower portion of FIG. 7. Further rotational displacement of the inner and outer feed/return links 160, 166 causes this combination to extend to the left of the figure where the pivot connection 168 to the cross bar (not shown) is located at die station no. 1. From the figure, it can be seen that the pivot connection 168 to the cross bar undergoes linear displacement between the two die stations.

Referring to FIG. 8, there is shown a perspective view of another drive arrangement for the fixed sprocket or tooth pulley 158 and outer sprocket or tooth pulley 164 in the transfer/feed mechanism shown in FIGS. 6 and 7. In the embodiment of FIG. 8, the idler gear in the transfer/feed mechanism has been replaced with a continuous chain, or tooth belt, 172 coupling the fixed sprocket or tooth pulley 158 to the outer sprocket or tooth pulley 164. Rotation of the inner feed/return link 160 shown in FIGS. 6 and 7 about the axis of the fixed sprocket or tooth pulley 158 causes the chain or drive tooth belt 172 to rotationally displace the outer sprocket or tooth pulley 164. Rotation of the outer sprocket or tooth pulley 164 causes a corresponding rotational displacement of the outer feed/return link 166 about the axis of coupling pin 170 as shown in FIGS. 6 and 7 and as described in detail above.

Figures 9A, 9B, 9C:
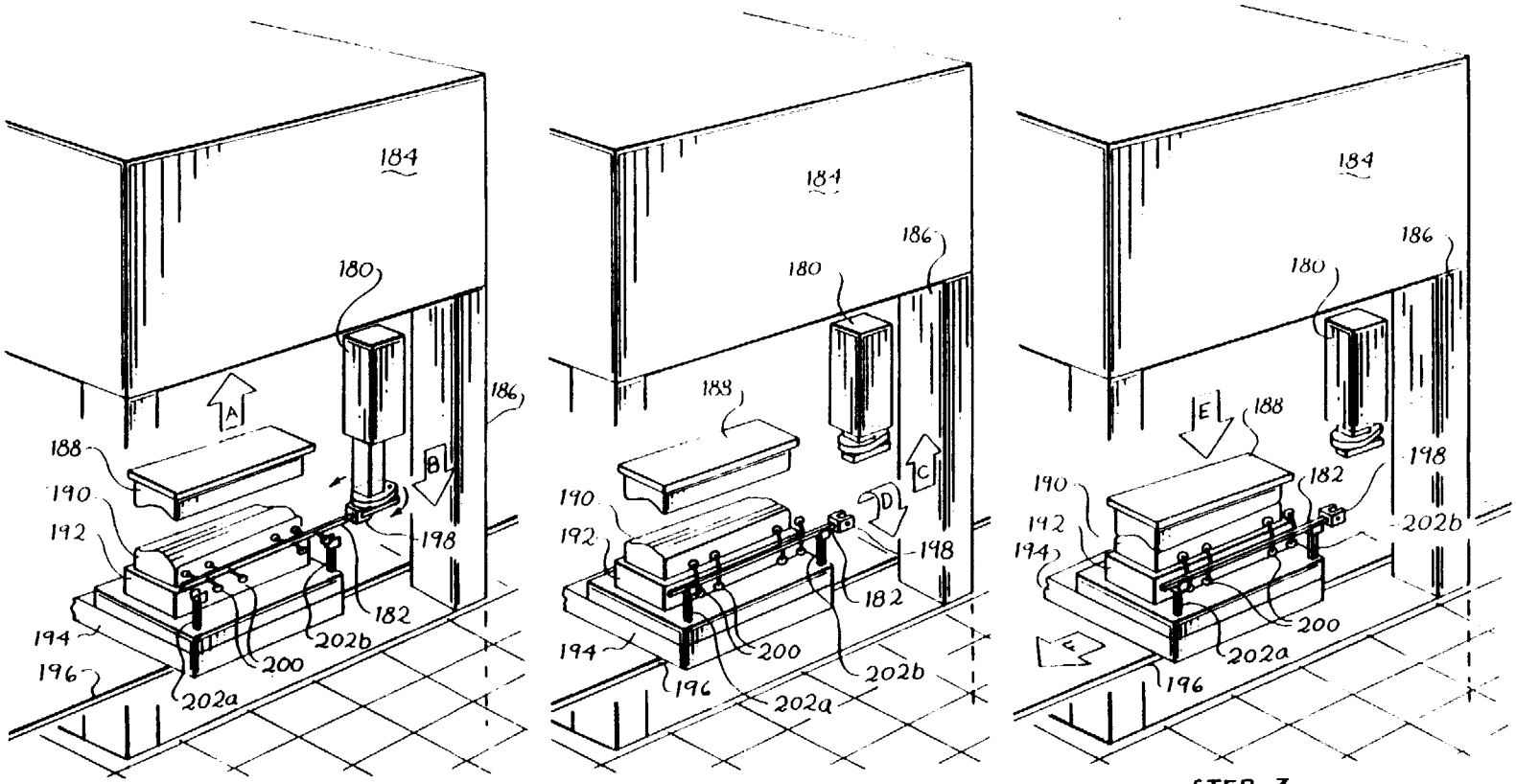
FIGS. 9*a*, 9*b* and 9*c* are perspective views illustrating the sequential operation of the inventive cross bar transfer press during die changeover to accommodate a new stamping operation employing different dies.

Referring to FIGS. 9*a*, 9*b* and 9*c*, there is shown the manner in which a transfer/feed mechanism 180 for use in the present invention may be disconnected from its associated cross bar 182 and retracted to a position which affords improved clearance to the dies for replacement and/or repair. In FIG. 9*a*, the upper, moveable die 188 has been retracted to the full up position by means of the press slide (which is not shown in the figures for simplicity). The lower, fixed die 190 is shown disposed on a die bolster 192, which, in turn, is positioned upon a bolster carrier 194. The bolster carrier 194 is moveable along a pair of tracks 196 (only one of which is shown in the figure) for replacing the upper and lower dies 188, 190 with another set of dies for another stamping operation. The arrangement for moving the die, bolster and carrier combination into and out of the mechanical transfer press may be conventional in design and operation, such as described above and shown in FIG. 2.

At A in step 1 as shown in FIG. 9*a*, the die slide is moved upward and the die combination is opened. Transfer/feed mechanism 180 then positions cross bar 182 which includes a plurality of spaced vacuum cups 200 above first and second cross bar supports 202*a* and 202*b*. First and second cross bar supports 202*a*, 202*b* are mounted to the bolster and carrier combination and include open, receptacle-like upper ends adapted to receive and support the cross bar 182. With the dies opened and the cross bar positioned above the first and second cross bar supports 202*a*, 202*b*, the cross bar is then lowered by means of the transfer/feed mechanism 180 onto the cross bar supports at B in step 1.

At C in step 2 as shown in FIG. 9*b*, the clamp 198 coupling the transfer/feed mechanism 180 to the cross bar 182 is detached with the cross bar then maintained in position by the first and second cross bar supports 202*a*, 202*b*. The transfer/feed mechanism 180 is then retracted so as to clear the upper die 188. At D in step 2, the cross bar is rotated 90° to also clear press upright 186. Cross bar rotation may be accomplished by either the clamp mechanism 198 connecting the cross bar 182 to the transfer/feed mechanism 180 or by means of the configuration of the first and second cross bar supports 202*a*, 202*b*. An example of a clamp for use in the present invention in attaching the cross bar 182 to the transfer/feed mechanism 180 is shown in FIGS. 10*a*, 10*b*, 11*a*, 11*b* and 12 and described in detail below. When this type of clamp is used for rotating the cross bar 182 as shown in FIG. 9*b*, cross bar rotation occurs in step 1.

With the transfer/feed mechanism 180 thus retracted so as to clear the die combination and the cross bar 182 rotated so as also to clear the uprights, the upper, moveable die 188 is then lowered on the lower die 190 by the press guide as shown at E, step 3, in FIG. 9*c*. With the upper die 188 resting on the lower die 190, the upper die is disconnected from the press slide and the bolster carrier 194 is then removed from the press as shown at F in step 3 to allow for insertion of another die combination in the press for a new stamping operation.

Figure 10A:
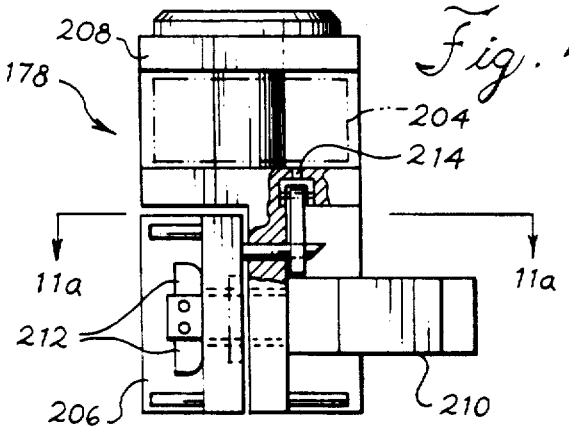
FIGS. 10*a* and 10*b* are end views of an automatic clamp arrangement for use in the cross bar transfer press respectively showing the transfer/feed mechanism coupled to and disengaged from the cross bar of the transfer press.
Figure 11A:
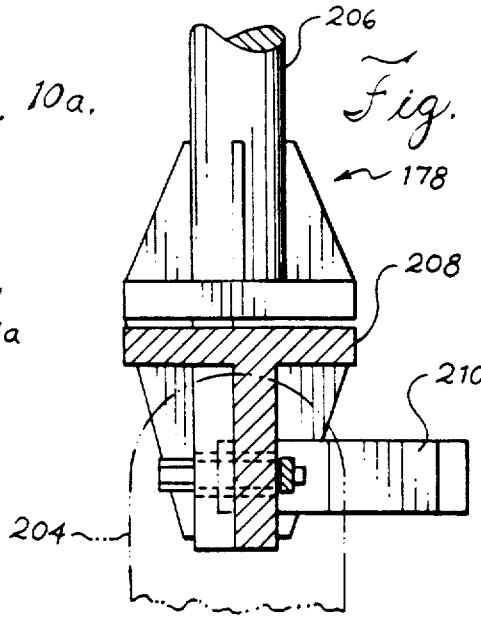
FIGS. 11*a* and 11*b* are sectional views of FIGS. 10*a* and 10*b* respectively taken along site lines 11*a*—11*a* and 11*b*—11*b* in those figures.
Figure 10B:
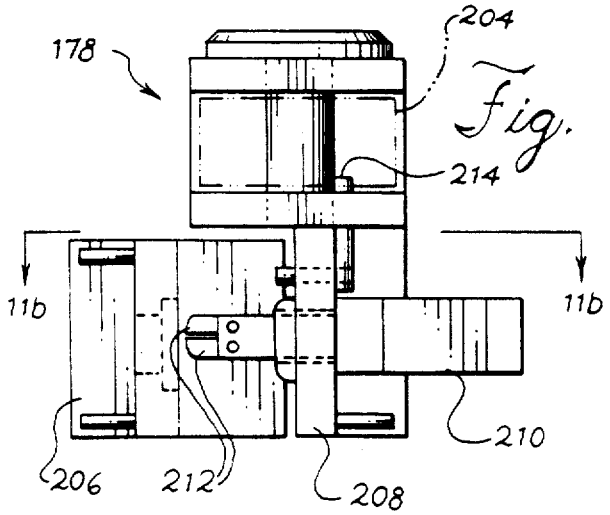
Figure 11B:
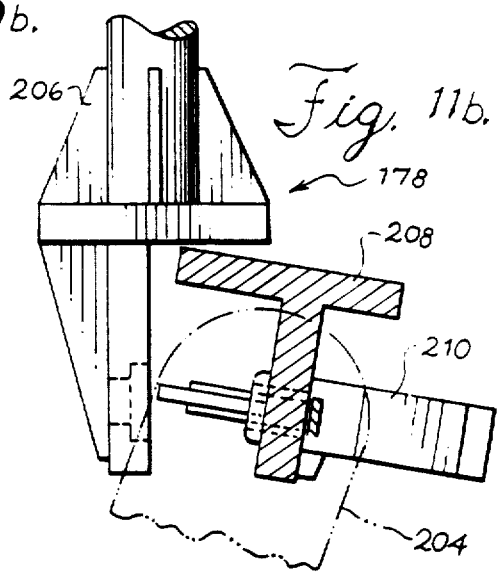
Figure 12:
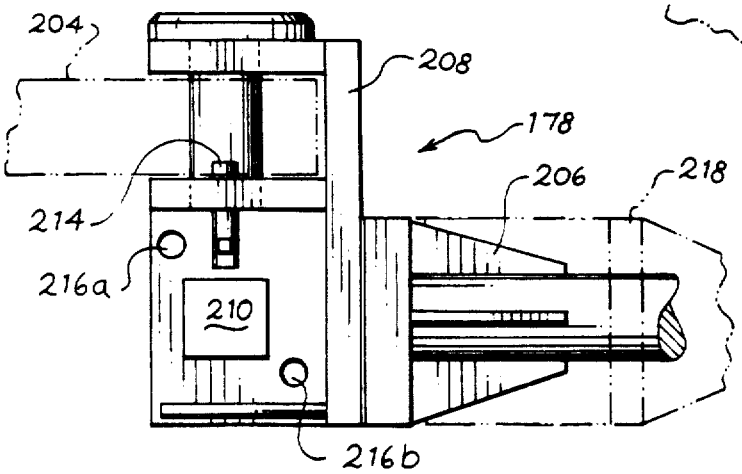
FIG. 12 is an end view of the automatic clamp arrangement illustrated in FIGS. 10*a*, 10*b* and 11*a*, 11*b*.

Referring to FIGS. 10*a* and 10*b*, there are respectively shown partially in phantom and partially cutaway side views of a clamp arrangement 178 for use in coupling the transfer/feed mechanism of FIG. 6 to a cross bar of a transfer press for use in the present invention. Sectional views of FIGS. 10*a* and 10*b* taken respectively along site lines 11*a*—11*a* and 11*b*—11*b* are shown in FIGS. 11*a* and 11*b*. An end view of the clamp arrangement 178 is shown in FIG. 12.

The clamp arrangement 178 includes a clevis 208 for attaching a transfer arm 204 to a cross bar 206. An air powered toggle clamp 210 is inserted through clevis 208 and a distal end portion of cross bar 206. An end of the air powered toggle clamp 210 includes a pair of retractable ears 212 adapted for engaging the cross bar 206 and maintaining the cross bar and transfer arm 204 in secure mutual engagement as shown in FIGS. 10*a* and 10*b*. Actuation of the toggle clamp 210 causes a retraction of ears 212 as shown in FIG. 10*b* allowing a withdrawal of the combination of the clevis and transfer arm 204 from the cross bar 206. Separation of the transfer arm 204 from the cross bar 206 is shown in FIGS. 10*b* and 11*b*. Vacuum ports 216*a* and 216*b* allow for vacuum control of the vacuum cups 102. Disposed within transfer arm 204 is a spring loaded pin 214 which is shown in FIGS. 10*b* and 12 in the engaged position to prevent swinging displacement of the clevis during automatic die changing. A tilt device 218 shown in FIG. 12 in dotted-line form may be attached to cross bar 206 to facilitate automatic die changing and part tilt during part feeding.

There has thus been shown an improved cross bar transfer press incorporating a plurality of paired self-supporting, stroke doubling transfer/feed mechanisms, with each pair coupled to a cross bar for transferring one or more piece parts from a first to a second stamping station. The transfer/feed mechanisms may be retracted when not in use to allow for access to the dies for repair or replacement. Each transfer/feed mechanism includes a pair of pivotally coupled links connected to a vertical positioning motor as well as to a rotational drive arrangement for engaging by means of vacuum cups and displacing piece parts between adjacent stamping stations. The inventive cross bar transfer press employs fewer drive motors than automated tandem press lines, requires reduced floor space because of the elimination of cam box and carriage structures such as in a tri-axis transfer drive mechanism, divides the transfer press into modular units for ease of maintenance and replacement, and allows for variation of transfer mechanism motion profile at each stamping station.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

I claim:

1. A transfer press wherein a piece part sequentially undergoes a series of stamping operations for forming said piece part into a desired configuration and size, said transfer press comprising:

a plurality of die means arranged in a linear, spaced manner for stamping a piece part in a predetermined sequence for forming the piece part into a desired configuration and size, each of said die means including a fixed lower die and a vertically moveable upper die adapted for engaging a piece part disposed on said lower die in a stamping manner;

a plurality of cross bars each disposed intermediate a pair of adjacent die means and having a longitudinal axis, wherein each of said cross bars includes gripping means for securely engaging a piece part, said cross bars fully extending across the width of said upper and lower dies.

a plurality of paired transport/feed means, each pair being separately operable from other pairs wherein each pair of transport/feed means is disposed intermediate adjacent die means and is coupled to a respective one of said cross bars for transferring one or more piece parts between adjacent die means, each of said transport/feed means including a pivotally displaced link coupled to a cross bar for moving said cross bar in a reciprocating manner between adjacent die means and in a direction generally transverse to the longitudinal axis of said cross bar; and control means coupled to each of said transport/feed means for moving said cross bars in timed sequence with operation of the transfer press.

2. The transfer press of claim 1, wherein each transport/feed means includes a vertically acting lift/lower motor and a horizontally acting feed/return motor.

3. The transfer press of claim 2, wherein each transport/feed means further includes a rack and pinion combination coupled to said vertically acting lift/lower motor for raising and lowering a cross bar and piece part attached thereto.

4. The transfer press of claim 2 further comprising inner and outer pivotally coupled links coupled to and displaced by said horizontally acting feed/return motor.

5. The transfer press of claim 4 further comprising a plurality of gears coupled to said horizontally acting feed/return motor and to said inner and outer pivotally coupled links.

6. The transfer press of claim 5, wherein said inner and outer links are fully extended when said cross bar is positioned at adjacent die means in the transfer press.

7. The transfer press of claim 6, wherein said inner and outer links are fully retracted when said cross bar is positioned intermediate adjacent die means in the transfer press.

8. The transfer press of claim 7, wherein said inner and outer links are disposed in vertical alignment, one above the other, when fully retracted.

9. The transfer press of claim 8, further comprising pivot coupling means for connecting each transport/feed means to a cross bar, wherein said pivot coupling means travels in a horizontal straight line between adjacent die means.

10. The transfer press of claim 9, wherein said pivot coupling means includes disconnect means for decoupling said transport/feed means from said cross bar.

11. The transfer press of claim 10, wherein said pivot coupling means includes pivot means for rotationally displacing said cross bar prior to decoupling from said transport/feed means.

12. A module for use in a mechanical transfer press having a plurality of such modules in stamping piece parts into a desired shape and size by a series of stamping operations, said module comprising:

a first stamping station including a lower fixed die and an upper moveable die adapted for engaging a piece part therebetween in a first stamping operation;

a cross bar disposed adjacent to said first stamping station and including a longitudinal axis and piece part engaging means for coupling to one or more piece parts at said first stamping station after said first stamping operation, said cross bar fully extending across the width of said upper and lower die; and first and second transfer/feed means coupled to respective ends of said cross bar for displacing said cross bar with said engaging means coupled to said one or more piece parts from said first stamping station to a second, adjacent stamping station in transferring said one or more piece parts between stamping operations, wherein each of said transfer/feed means includes a drive arrangement independent in operation of any other module and wherein said cross bar is displaced in a direction generally transverse to its longitudinal axis.

13. The module of claim 12, wherein said drive arrangement includes a vertically acting motor and a horizontally acting motor for displacing said cross bar and said engaging means with a piece part coupled thereto between adjacent modules.

14. The module of claim 13, wherein each of said transfer/feed means includes a plurality of pivotally coupled arms fully extended when said cross bar is positioned at one of said stamping stations and fully retracted during stamping of the piece parts.

15. The module of claim 12, wherein said engaging means includes decoupling means for detachment from said cross bar and facilitating access to or replacement of said first or second stamping station.

16. The module of claim 12, wherein each of said transfer/feed means is self-supporting and is removable from between adjacent stamping stations to facilitate die replacement or repair.

17. A mechanical transfer press comprising:

first and second stamping stations for stamping a piece part into a desired configuration, each of said stamping stations including a respective pair of a lower fixed die disposed on a bolster and an upper movable die;

a cross bar disposed intermediate said fist and second stamping stations and including gripper means for securely engaging a piece part said cross bar fully extending across the width of said upper and lower die;

first and second transfer/feed mechanisms disposed intermediate said stamping stations and pivotally coupled to respective ends of said cross bar for displacing said cross bar generally transverse to a longitudinal axis of said cross bar and between said first and second stamping stations and transferring a piece part from the pair of dies of said first stamping station to the pair of dies of said second stamping station;

control means coupled to said first and second transfer/feed mechanisms for transferring a piece part between said first and second stamping stations in timed sequence with the operation of said transfer press;

automatic clamp means coupling each of said first and second transfer/feed mechanisms to a respective end of said cross bar in a releasable manner to facilitate replacement of said dies; and support means disposed on said bolster intermediate said first and second stamping stations for receiving said cross bar when released from said transfer/feed mechanisms.

18. A transfer mechanism for use in a mechanical press in transferring piece parts from a first die stamping station to a second die stamping station, said transfer mechanism comprising:

vacuum means for securely engaging a piece part;

a cross bar coupled to said vacuum means and aligned generally transverse to the direction of travel of the piece parts and disposed between the first and second stamping stations, said cross bar fully extending across the width of upper and lower dies in said first and second stations;

first and second pivoting arm means coupled to respective ends of said cross bar and displaced laterally from and outside of the path of travel of the piece parts between the first and second stamping stations;

first and second drive means respectively coupled to said first and second pivoting arm means for pivotally displacing said arm means in a reciprocating manner in moving said cross bar between said first and second stamping stations; and third and fourth drive means respectively coupled to said first and second pivoting arm means for sequentially raising and lowering said cross bar in lifting a piece part from the first stamping station and depositing it on the second stamping station, said first, second, third and fourth drive means being independently controlled.

19. The transfer mechanism of claim 18 wherein said vacuum means includes a plurality of vacuum cups.

20. The transfer mechanism of claim 18 further comprising first and second clamp means for pivotally coupling said first and second pivot arm means to respective ends of said cross bar.

21. The transfer mechanism of claim 20 wherein said first and second clamp means are displaced along respective straight lines between the first and second stamping stations.

22. The transfer mechanism of claim 21 wherein each of said first and second clamp means includes a disconnect arrangement for releasing said cross bar to facilitate changing of the dies.

23. The transfer mechanism of claim 18 wherein each of said first and second pivoting arm means includes an inner link and an outer link pivotally coupled and adapted for displacement about a pivot axis laterally displaced from and outside the path of travel of the piece parts between the first and second stamping stations.

24. The transfer mechanism of claim 23 wherein each of said first and second drive arrangements includes a motor and gear combination for pivotally displacing said inner and outer links about said pivot axis.

25. The transfer mechanism of claim 24 wherein each of said third and fourth drive means includes a rack and pinion arrangement in combination with a drive motor for raising and lowering said cross bar and a piece part coupled thereto.

* * * * *

UNITED STATES PATENT AND TRADEMARK OFFICE

CERTIFICATE OF CORRECTION

PATENT NO. : 5,140,839

DATED : August 25, 1992

INVENTOR(S) : Eilert F. Bruns

It is certified that error appears in the above-identified patent and that said Letters Patent is hereby corrected as shown below:

| COLUMN | LINE | |
|---|---|---|
| 1 | 45 | Insert --1,-- after --FIG.--. |
| 7 | 49 | "a" should be --an--. |

Signed and Sealed this

Twelfth Day of April, 1994

Bruce Lehman

BRUCE LEHMAN

*Commissioner of Patents and Trademarks*

*Attest:*

*Attesting Officer*